US008256223B2

(12) United States Patent
Dierberger et al.

(10) Patent No.: US 8,256,223 B2
(45) Date of Patent: Sep. 4, 2012

(54) CERAMIC COMBUSTOR LINER PANEL FOR A GAS TURBINE ENGINE

(75) Inventors: James A. Dierberger, Hebron, CT (US); Kevin W. Schlichting, Storrs, CT (US); Melvin Freling, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 1515 days.

(21) Appl. No.: 11/872,782

(22) Filed: Oct. 16, 2007

(65) Prior Publication Data

US 2012/0125005 A1 May 24, 2012

(51) Int. Cl.
*F02C 1/00* (2006.01)

(52) U.S. Cl. ..... 60/753; 60/752

(58) Field of Classification Search ..... 60/752–760, 60/772, 796, 800
See application file for complete search history.

(56) References Cited

U.S. PATENT DOCUMENTS

| | | | | |
|---|---|---|---|---|
| 4,363,208 | A | 12/1982 | Hoffman et al. | |
| 5,079,915 | A * | 1/1992 | Veau | 60/766 |
| 5,331,816 | A | 7/1994 | Able et al. | |
| 5,553,455 | A * | 9/1996 | Craig et al. | 60/753 |
| 5,592,814 | A | 1/1997 | Palusis et al. | |
| 6,299,935 | B1 | 10/2001 | Park et al. | |
| 6,358,002 | B1 | 3/2002 | Good et al. | |
| 6,428,280 | B1 | 8/2002 | Austin et al. | |
| 6,435,824 | B1 | 8/2002 | Schell et al. | |
| 6,443,700 | B1 | 9/2002 | Grylls et al. | |
| 6,511,630 | B1 | 1/2003 | Cartier et al. | |
| 6,648,596 | B1 | 11/2003 | Grylls et al. | |
| 6,920,762 | B2 | 7/2005 | Wells et al. | |
| 7,237,389 | B2 | 7/2007 | Ryan et al. | |
| 2003/0123953 | A1 | 7/2003 | Razzell | |
| 2005/0249602 | A1 | 11/2005 | Freling et al. | |
| 2006/0242965 | A1 | 11/2006 | Shi et al. | |

FOREIGN PATENT DOCUMENTS

| | | | |
|---|---|---|---|
| EP | 1719949 | A2 | 11/2006 |
| EP | 1741981 | A1 | 1/2007 |

* cited by examiner

*Primary Examiner* — Ehud Gartenberg
*Assistant Examiner* — Arun Goyal
(74) *Attorney, Agent, or Firm* — Carlson, Gaskey & Olds PC

(57) ABSTRACT

A combustor assembly includes a support structure and at least one combustor liner panel selectively attached to the support structure. The combustor liner panel includes an uncooled ceramic portion, a cooled ceramic portion and a support that receives the cooled ceramic portion.

2 Claims, 4 Drawing Sheets

CERAMIC COMBUSTOR LINER PANEL FOR A GAS TURBINE ENGINE

BACKGROUND OF THE INVENTION

This application relates to a gas turbine engine having an improved combustor liner panel for a combustor section of the gas turbine engine.

Gas turbine engines include numerous components that are exposed to high temperatures. Among these components are combustion chambers, exhaust nozzles, afterburner liners and heat exchangers. These components may surround a portion of a gas path that directs the combustion gases through the engine and are often constructed of heat tolerant materials.

For example, the combustor chamber of a combustor section of a gas turbine engine may be exposed to local gas temperatures that exceed 3,500° F. (1927° C.). The hotter the combustion and exhaust gases, the more efficient the operation of the jet engine becomes. Therefore, there is an incentive to raise the combustion exhaust gas temperatures of the gas turbine engine.

Combustor liner panels made from exotic metal alloys are known that can tolerate increased combustion exhaust gas temperatures. However, exotic metal alloys have not effectively and economically provided the performance requirements required by modern gas turbine engines. Additionally, metallic combustor liner panels must be cooled with a dedicated airflow bled from another system of the gas turbine engine, such as the compressor section. Disadvantageously, this may cause undesired reductions in fuel economy and engine efficiency.

Ceramic materials are also known that provide significant heat tolerance properties due to their high thermal stability. Combustor assemblies having ceramic combustor liner panels typically require a reduced amount of dedicated cooling air to be diverted from the combustion process for purposes of cooling the combustor liner panels. However, known ceramic combustor liner panels are not without their own drawbacks. Disadvantageously, integration of ceramic liner panels into a substantially metallic combustor assembly is difficult. In addition, differences in the rate of thermal expansion of the ceramic combustor liner panels and the metal components the liner panels are attached to may subject the liner panels to unacceptable high stresses and/or potential failure.

Accordingly, it is desirable to provide an improved ceramic combustor liner panel that is uncomplicated, lightweight, simple to incorporate into the combustor section, and that requires minimal cooling airflow.

SUMMARY OF THE INVENTION

A combustor support-liner assembly includes a support structure and at least one combustor liner panel selectively attached to the support structure. The combustor liner panel includes an uncooled ceramic portion, a cooled ceramic portion and a support that receives the cooled ceramic portion.

A gas turbine engine includes a compressor section disposed about an engine longitudinal centerline axis, a turbine section downstream of the compressor section, and a combustor section positioned between the compressor section and the turbine section. The combustor section includes a support structure and a combustor liner panel. The combustor liner panel includes an uncooled ceramic portion, a cooled ceramic portion, and a support that receives the cooled ceramic portion.

A method of attaching a combustor liner panel to a gas turbine engine includes attaching an uncooled ceramic portion of the combustor liner panel to a cooled ceramic portion of the combustor liner panel, and attaching the cooled ceramic portion to a support of the combustor liner panel.

The various features and advantages of this invention will become apparent to those skilled in the art from the following detailed description. The drawings that accompany the detailed description can be briefly described as follows.

DETAILED DESCRIPTION OF AN EXAMPLE EMBODIMENT

Figure 1:
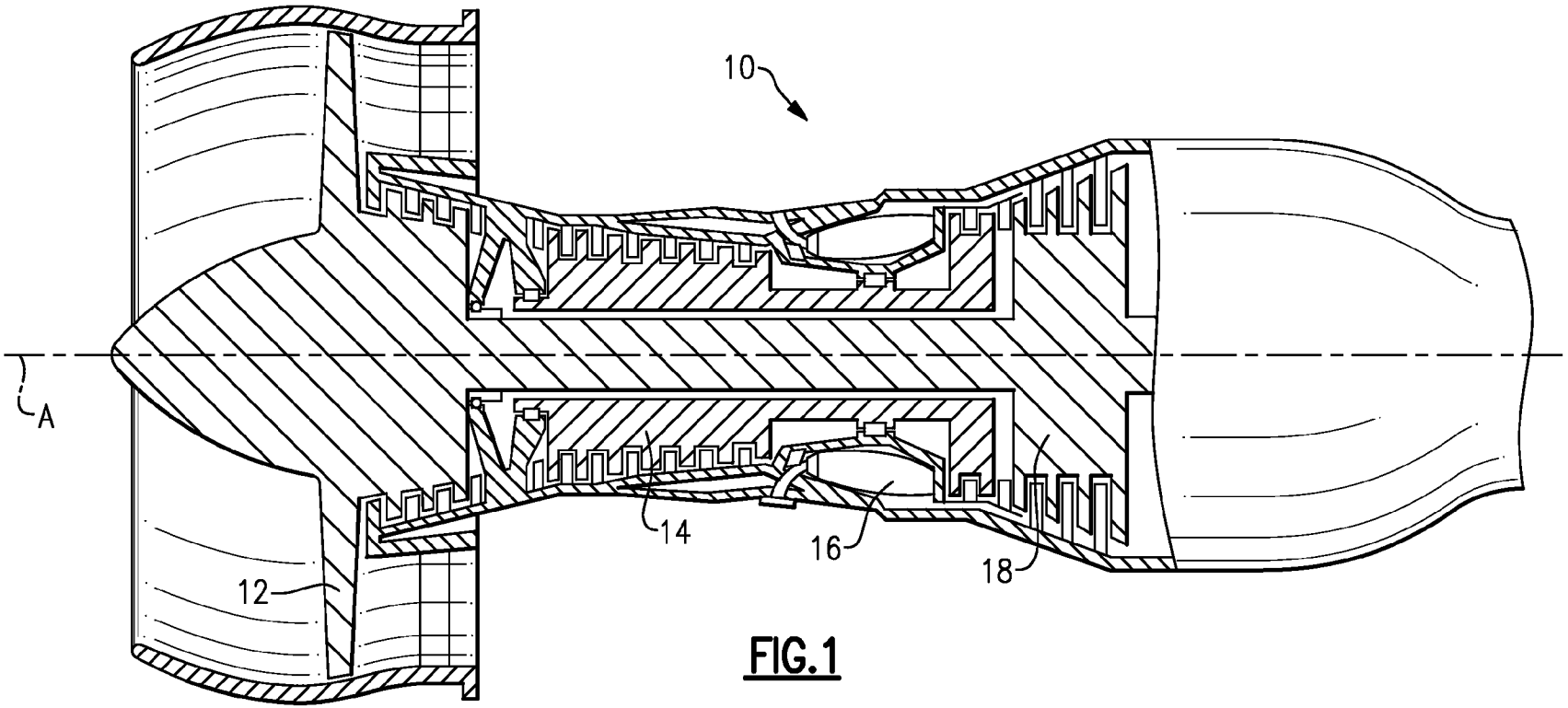
FIG. 1 illustrates a general prospective view of an example gas turbine engine.

FIG. 1 illustrates a gas turbine engine 10 that includes (in serial flow communication) a fan section 12, a compressor section 14, a combustor section 16, and a turbine section 18 each disposed about an engine longitudinal centerline axis A. During operation, air is pressurized in the compressor section 14 and mixed with fuel in the combustor section 16 for generating hot combustion gases. The hot combustion gases flow through the turbine section 18 which extracts energy from the hot combustion gases. The turbine section 18 utilizes the power extracted from the hot combustion gases to power the fan section 12 and the compressor section 14. FIG. 1 is a highly schematic representation of a gas turbine engine and is presented for illustrative purposes only. There are various types of gas turbine engines, many of which would benefit from the examples described within this application. That is, the examples are applicable to any gas turbine engine, and to any application.

Figure 2:
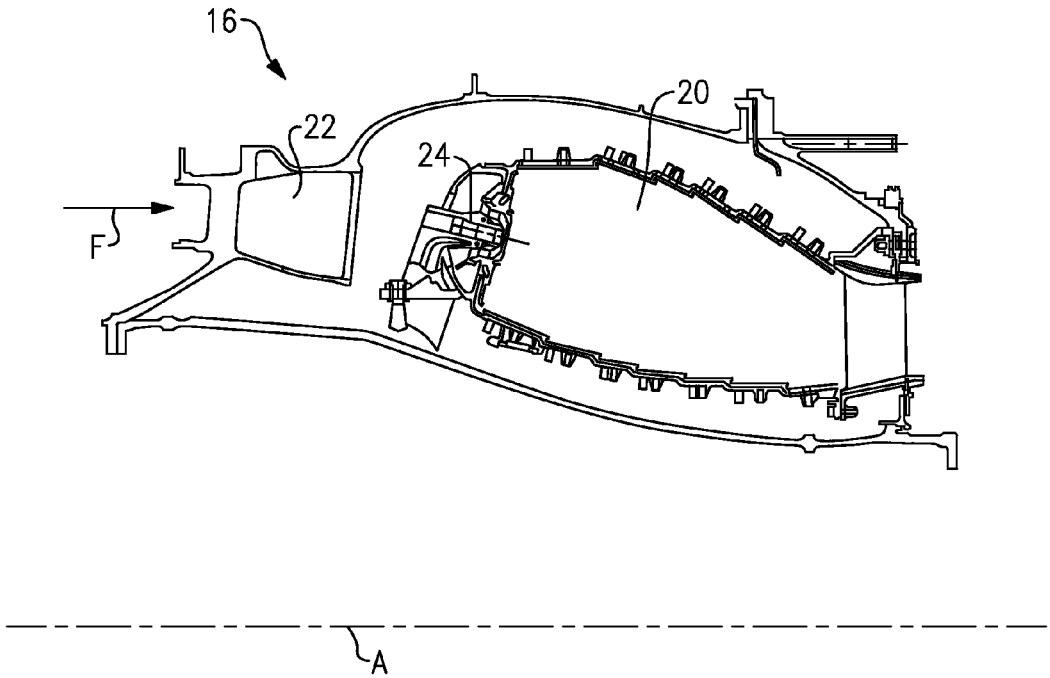
FIG. 2 illustrates a combustor section of the example gas turbine engine illustrated in FIG. 1.

FIG. 2 illustrates an example combustor section 16 of the gas turbine engine 10. In one example, the combustor section 16 is an annular combustor. That is, a combustion chamber 20 of the combustor section 16 is disposed circumferentially about the engine centerline axis A. Airflow F communicated from the compressor section 14 is received in the combustor section 16 and is communicated through a diffuser 22 to reduce the velocity of the airflow F. The airflow F is communicated into the combustion chamber 20 and is mixed with fuel that is injected by a fuel nozzle 24. The fuel/air mixture is next burned within the combustion chamber 20 to convert chemical energy into heat, expand air, and accelerate the mass flow of the combustion gases through the turbine section 18. Although only a single fuel nozzle 24 is illustrated, it should be understood that the combustor section 16 will include a plurality of fuel nozzles 24 disposed circumferentially about the gas turbine engine 10 within the combustor section 16 (See FIG. 5).

Figure 3:
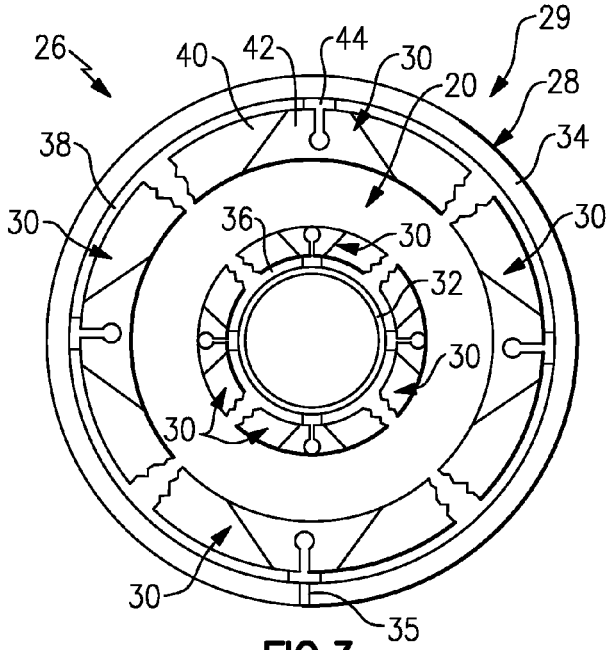
FIG. 3 illustrates a combustor support-liner assembly of the combustor section of the example gas turbine engine illustrated in FIG. 1.

FIG. 3 illustrates an example support-liner assembly 26 for mounting in the combustion chamber 20 of the combustor section 16. The support-liner assembly 26 includes a support structure 29 and a plurality of combustor liner panels 30. It should be understood that the actual number of combustor liner panels 30 included on the support-liner assembly 26 will vary, as indicated by the broken lines, depending upon design specific parameters including, but not limited to, the gas turbine engine type and performance requirements.

In this example, the support structure 29 is a cage assembly 28 made of a metallic material, such as a nickel alloy or composite material, for example. In another example, the support structure 29 is a shell assembly 31 (See FIG. 5). The combustor liner panels 30 include a ceramic foam. In one example, the ceramic foam includes a ceramic material selected from at least one of zirconia, yttria-stabilized zirconia, silicon carbide, alumina, titania, or mullite. It should be understood that other materials and structural designs may be appropriate for the support structure 29 and the combustor liner panels 30 as would be understood by a person of ordinary skill in the art having the benefit of this disclosure.

The example cage assembly 28 illustrated in FIG. 3 is configured and supported within the combustor section 16 in any known manner. A person of ordinary skill in the art having the benefit of this disclosure would be able to mount the cage assembly 28 to the combustor section 16. In one example, the cage assembly 28 includes an inner cage 32 and an outer cage 34 for positioning and supporting the combustor liner panels 30. The combustor liner panels 30 of the inner cage 32 face a radial outward direction (i.e., towards the outer cage 34), in one example. The combustor liner panels 30 of the outer cage 34 face a radial inward direction (i.e., towards the inner cage 32), in another example. That is, the combustion chamber 20 extends between the combustor liner panels 30 of the inner cage 32 and the outer cage 34.

A first plenum 36 is formed between the inner cage 32 and the combustor liner panels 30 attached to the inner cage 32. A second plenum 38 extends between the outer cage 34 and the combustor liner panels 30 of the outer cage 34. The plenums 36, 38 communicate airflow from behind the fuel nozzles 24 and through a portion of the combustor liner panels 30 into the combustion chamber 20 to cool the combustion chamber 20, as is further discussed below. The cooling air is required to reduce the risk of the combustion gases burning or damaging the combustion chamber 20.

It should be understood that the cage assembly 28, the combustor liner panels 30 and the plenums 36, 38 are not shown to the scale they would be in practice. Instead, these components are shown larger than in practice to better illustrate their function and interaction with one another. A worker of ordinary skill in this art will be able to determine an appropriate positioning and spacing of these components for a particular application, and thereby appropriately size and configure the support-liner assembly 26.

Figure 4:
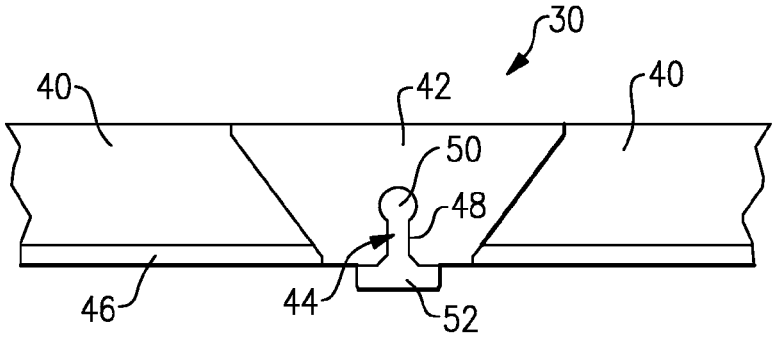
FIG. 4 illustrates an example ceramic combustor liner panel of the combustor section illustrated in FIG. 3.

Referring to FIGS. 3 and 4, each combustor liner panel 30 includes an uncooled ceramic portion 40, a cooled ceramic portion 42 and a support 44. The uncooled ceramic portion 40 includes a backing layer 46 positioned on a side of the uncooled ceramic portion 40 that faces the plenum 36, 38 associated with cage 32, 34 the combustor liner panel 30 is attached to. In one example, the backing layer 46 is 100% dense. The backing layer 46 blocks airflow from the plenums 36, 38 such that the ceramic portions 40 are substantially uncooled by airflow received from the plenums 36, 38.

In one example, the supports 44 are made of a metallic material. In another example, the supports 44 are made of metallic foam. The cooled ceramic portions 42 of the combustor line panels 30 are received on the supports 44 of the combustor line panels 30. In one example, the cooled ceramic portions 42 include a groove 48 formed therein. The groove 48 of the cooled ceramic portion 42 is received on a tongue 50 of the support 44 to mount the cooled ceramic portion 42 to the support 44. It should be understood that the cooled ceramic portions 42 may be attached to the support 44 in any known manner. The uncooled ceramic portions 40 are attached to the cooled ceramic portion 42 in a casting process, for example, as is further discussed below.

The support 44 also includes a base portion 52. Each combustor liner panel 30 is attached to the inner cage 32 or the outer cage 34 via the base portion 52 of the support 44. In one example, the base portion 52 of each support 44 is brazed to the inner cage 32 or the outer cage 34. In another example, a rivet is used to attach the combustor liner panels 30 to the cages 32, 34 (see FIG. 3). In yet another example, the base portion 52 of the support 44 is welded to the inner cage 32 or the outer cage 34. A person of ordinary skill in the art having the benefit of this disclosure would be able to attach the combustor liner panels 30 to the cage assembly 28 via the supports 44.

Figure 5:
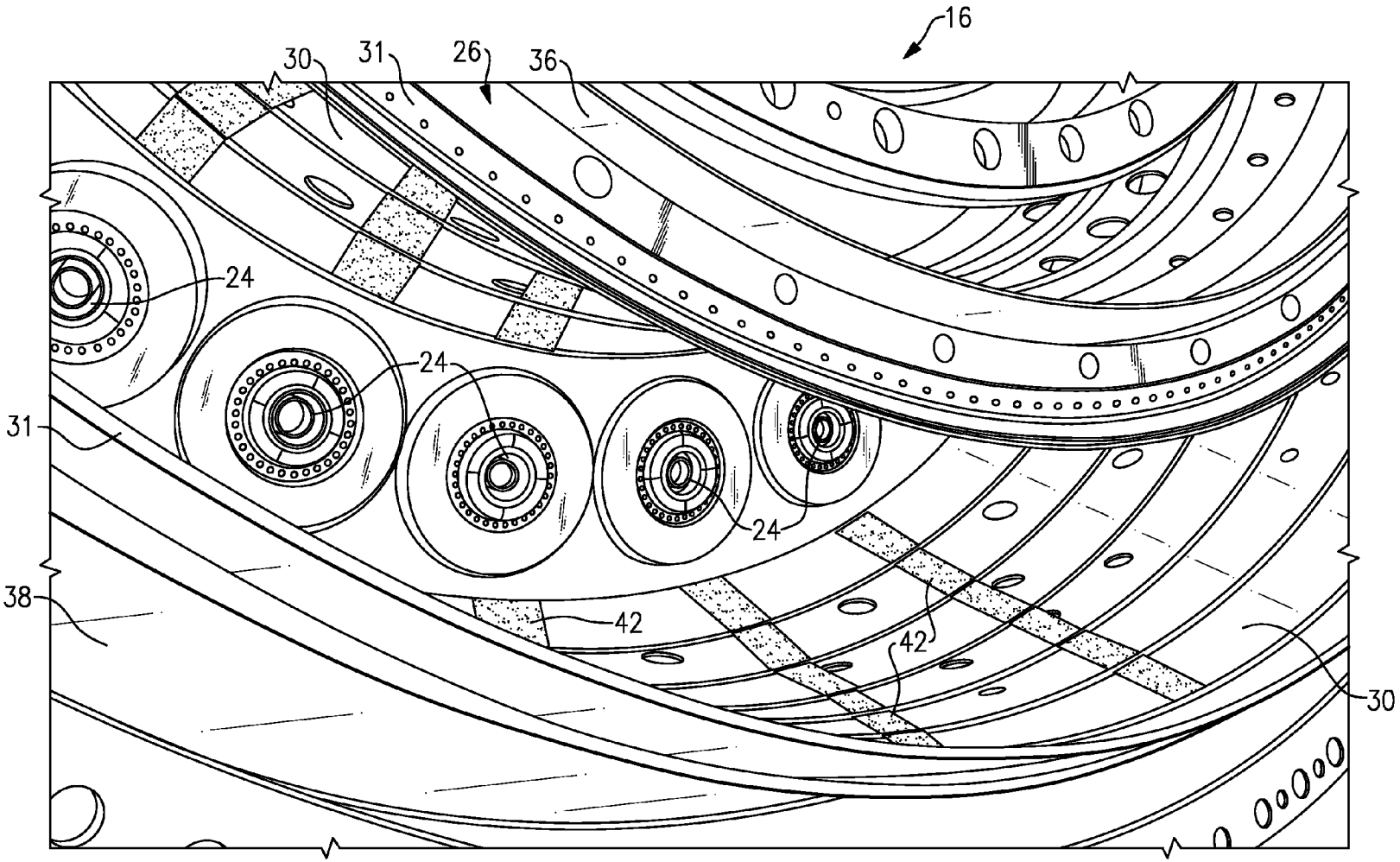
FIG. 5 illustrates a portion of the combustor section including an example alignment of cooled ceramic portions of the combustor liner panels within the combustor section.

FIG. 5 illustrates a portion of the combustor section 16 including the support-liner assembly 26. In this example, the combustor liner panels 30 are attached to the shell assembly 31 and are positioned such that the cooled ceramic portions 42 are substantially aligned in an axial direction with the fuel nozzles 24 of the combustor section 16. That is, the cooled ceramic portions 42 of the combustor liner panels 30 are aligned with the fuel nozzles 24 and oriented such that the cooled ceramic portions 42 are generally in-line or under a hot spot of the combustion chamber 20. The hot spots of the combustion chamber 20 occur generally in-line with each fuel nozzle 24.

Judicious alignment of the support 44 and the cooled ceramic portions 42 of the combustor liner panels 30 with the hot spots of the fuel nozzles 24 reduces the thermal gradients of the cooled ceramic portions 42, lowers stress, and increases combustor section 16 durability. Although the cooled ceramic portions 42 are illustrated in-line with the fuel nozzles 24, it should be understood that the actual alignment may be slightly off-center from the fuel nozzles due to the amount of swirl experienced by the fuel as it is injected from the fuel nozzles 24. A person of ordinary skill in the art would understand how to align the cooled ceramic portions 42 relative to the hot spots of the combustion chamber 20.

Cooling airflow from the plenums 36, 38 is communicated through each support 44, through each cooled ceramic portion 42, and into the combustion chamber 20 to cool the combustor section 16. In addition, since each support 44 is cooled, stress on each support 44 is minimized which increases the service life of each combustor liner panel 30. In one example, the supports 44 and the cooled ceramic portions 42 are transpiration cooled. Transpiration cooling involves forcing air, such as compressed cooling air, through a porous article to remove heat. The cooling air remains in contact with the material of the article for a relatively long period of time so that a significant amount of heat may be transferred into the air and thence removed from the article. Other cooling methods are also within the scope of this application.

Figure 6:
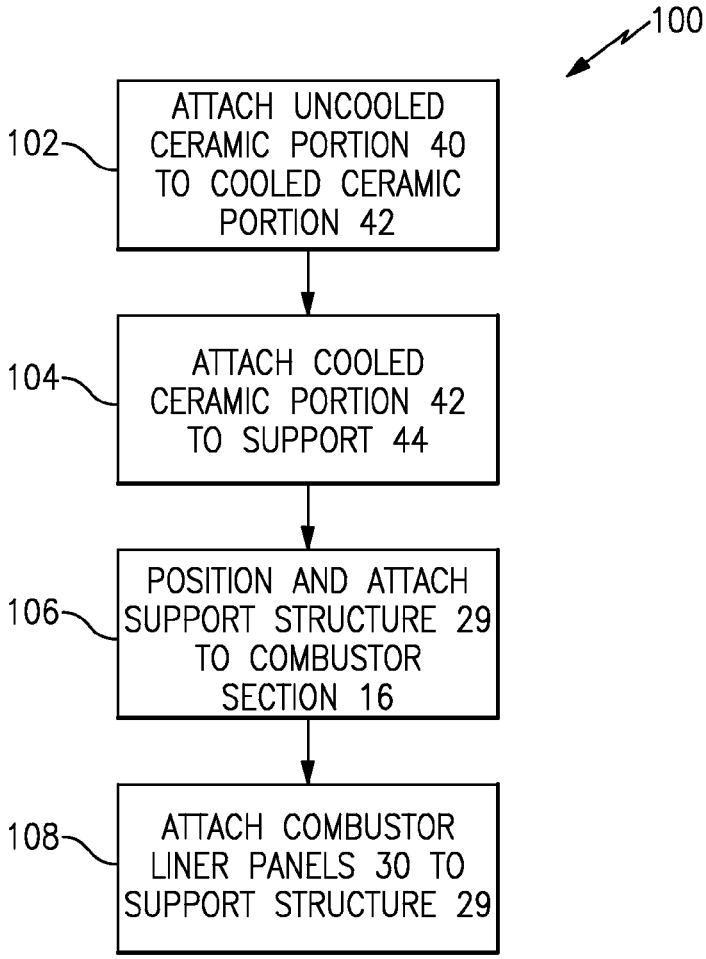
FIG. 6 illustrates an example method of attaching and supporting a ceramic combustor liner panel relative to a gas turbine engine.

FIG. 6, with continuing reference to FIGS. 1-5, illustrates an example method 100 for attaching a combustor liner panel 30 to a combustor section 16 of a gas turbine engine 10. At step block 102, an uncooled ceramic portion 40 of the combustor liner panel 30 is attached to a cooled ceramic portion 42 of the combustor liner panel 30. In one example, the uncooled ceramic portion 40 is attached to the cooled ceramic portion 42 in a casting process. For example, a pre-form is made and filled with a polymer, such as a sponge material. Next, the pre-form is infiltrated with a ceramic slurry. The ceramic slurry is dried and then fired at a high temperature (around 2,500° F. (1371° C.) or above). The firing process burns out and removes the polymer to create areas of porosity within the ceramic panels. The ceramic panels are then cut into desired sizes to provide the combustor liner panels 30. The combustor liner panels 30 may be fabricated using any suitable method. In addition, a backing layer 46 may be provided on the uncooled ceramic portions 40.

Next, at step block 104, the cooled ceramic portion 42 of the combustor liner panel 30 is attached to the support 44 of each combustor liner panel 30. In one example, a groove is machined into the cooled ceramic portion 42 and is inserted onto a tongue portion 50 of the support 44.

The combustor liner panels 30 are attached to the support structure 29, such as the cage assembly 28, for example, at step block 106. A person of ordinary skill in the art having the benefit of this disclosure would understand that other support structures may be utilized for attaching the combustor liner panels 30. The combustor liner panels 30 are attached to the cage assembly 28 via the supports 44. In one example, a rivet 35 (FIG. 3) is utilized to attach the combustor liner panels 30 to the cage assembly 28 via the supports 44. In another example, the supports 44 are welded to the cage assembly 28. In yet another example, the supports 44 are brazed to the cage assembly 28. Finally, at step block 108, the cage assembly 28 is positioned and attached to the combustor section 16 about the longitudinal centerline axis of the gas turbine engine 10. The cage assembly 28 is affixed to the combustor section 16 in any known manner.

The present application provides a combustor section 16 including combustor liner panels 30 made of ceramic foam materials that require a reduced amount of dedicated cooling air. The reduction in dedicated combustor cooling air for the combustor liner panels 30 can be used to increase engine efficiency and/or improve fuel economy. The supports 44 of the combustor line panels 30 provide a simple attachment method for attaching the combustor liner panels 30 to the cage assembly 28 of the combustor section 16.

The foregoing description shall be interpreted as illustrative and not in any limiting sense. A worker of ordinary skill in the art would recognize that certain modifications would come within the scope of this invention. For that reason, the following claims should be studied to determine the true scope and content of this invention.

What is claimed is:

1. A combustor support-liner assembly, comprising:

a support structure having an inner cage and an outer cage that surrounds said inner cage;

a plurality of combustor liner panels disposed circumferentially about each of said inner cage and said outer cage, and said plurality of combustor liner panels of said inner cage face radially outwardly toward said outer cage and said plurality of combustor liner panels of said outer cage face radially inwardly toward said inner cage, wherein each of said plurality of combustor liner panels includes a cooled ceramic portion that circumferentially extends between a first uncooled ceramic portion and a second uncooled ceramic portion and a support that receives said cooled ceramic portion;

a first plenum that extends between said inner cage and said plurality of combustor liner panels of said inner cage; and a second plenum that extends between said outer cage and said plurality of combustor liner panels of said outer cage.

2. The assembly as recited in claim 1, wherein said first uncooled ceramic portion and said second uncooled ceramic portion include a backing layer that is 100% dense.

* * * * *